US005122944A

United States Patent [19]

Webb

[11] Patent Number: 5,122,944

[45] Date of Patent: Jun. 16, 1992

[54] MOUNTING ARRANGEMENT FOR A LAMP FITTING

[75] Inventor: John C. Webb, Cheshunt, England

[73] Assignee: Thorn Emi plc, London, England

[21] Appl. No.: 541,799

[22] Filed: Jun. 21, 1990

[30] Foreign Application Priority Data

Jun. 27, 1989 [GB] United Kingdom ..... 8914723
Apr. 24, 1990 [GB] United Kingdom ..... 9009118

[51] Int. Cl.[5] ..... F21S 1/02

[52] U.S. Cl. ..... 362/365; 362/147; 362/364

[58] Field of Search ..... 362/147, 148, 364, 365, 362/404

[56] References Cited

U.S. PATENT DOCUMENTS

| | | | |
|---|---|---|---|
| 4,250,540 | 2/1981 | Kristofek | 362/404 |
| 4,293,895 | 10/1981 | Kristofek | 362/365 X |
| 4,716,504 | 12/1987 | Pahl et al. | 362/365 X |
| 4,739,460 | 4/1988 | Kelsall | 362/365 |

FOREIGN PATENT DOCUMENTS

| | | | |
|---|---|---|---|
| 249102 | 1/1964 | Australia | 362/365 |
| 2242400 | 3/1974 | Fed. Rep. of Germany | 362/365 |
| 3013715 | 10/1981 | Fed. Rep. of Germany | 362/364 |
| 1216724 | 11/1959 | France | 362/365 |
| 1219913 | 5/1960 | France . | |
| 1452709 | 9/1966 | France . | |
| 1558546 | 1/1969 | France | 362/365 |

*Primary Examiner*—Ira S. Lazarus
*Assistant Examiner*—Y. Quach
*Attorney, Agent, or Firm*—Fleit, Jacobson, Cohn, Price, Holman & Stern

[57] ABSTRACT

A mounting arrangement is provided for mounting a lamp fitting on a planar support, it comprises: a plurality of carrier means secured to the lamp fitting, each carrier means having at least one linear series of parallel tooth members; and a plurality of support members, each support member including means for locating the support member on a respective carrier means and at least one engagement surface for engagement with a chosen tooth member such that in use of the mounting arrangement, the engagement surface is maintained in engagement with the tooth member by the weight of the fitting acting on the engagement surface.

10 Claims, 7 Drawing Sheets

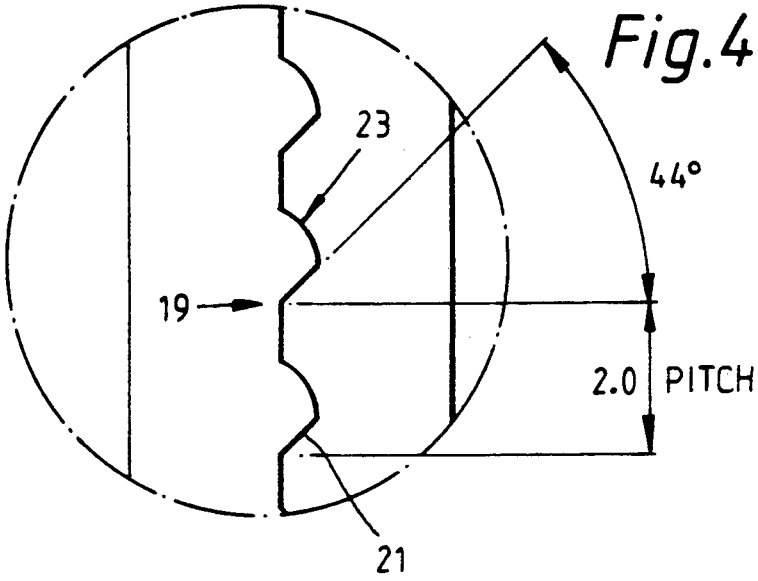
Fig.4
Fig.5
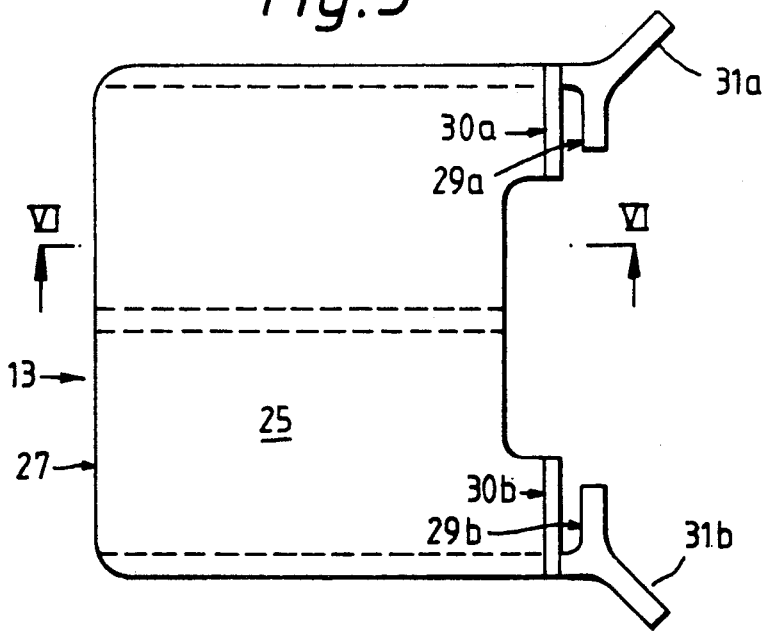

MOUNTING ARRANGEMENT FOR A LAMP FITTING

This invention relates to mounting arrangements for lamp fittings. The invention has particular, although not exclusive relevance to mounting arrangements for lamp fittings where the lamp fittings are to be mounted in an aperture in a support member, for example a suspended ceiling.

In such lamp fittings it is often necessary to provide a mounting arrangement which allows the amount by which the fitting projects through the aperture to be adjusted. In U.S. Pat. No. 4,250,540 there is described an example of such a mounting arrangement for a lamp fitting in which two diametrically opposed T-shaped slots are formed in the cylindrical side wall of the housing for the fitting. A sprung steel mounting clip is provided in respect of each slot, each clip incorporating a flange portion having feet, a central portion connected to the flange portion by a neck portion of reduced width, a second flange portion attached to the central portion by a second neck portion of reduced width, and an operating tab extending from the central portion. In use of the clip the operating tab is used to position the clip with the central portion inside the housing and the first and second flange portions outside the housing, with the two neck portions extending through the vertical of one of the T shaped slots. The clip is sprung such that the feet engage the upper surface of the support member, the spring action of the clip forcing the second flange portion into engagement with corrugations formed on the housing at the edges of the vertical leg of the T shaped slot. By movement of the operating tab the second flange may be disengaged from the corrugations, and the clip moved along the vertical leg of the T shaped slot thus allowing the amount by which the fitting projects through the aperture to be varied.

Such a mounting arrangement suffers the disadvantage that the sprung clip is relatively complex and costly to manufacture. Furthermore the clamping action of the clip relies on the continued resilence of the clip.

It is an object of the present invention to provide a mounting arrangement for a lamp fitting suitable for mounting the fitting in an aperture of a support member, whereby the amount by which the fitting projects through the aperture may be adjusted.

According to a first aspect of the present invention a mounting arrangement for mounting a lamp fitting on a planar support comprises: a plurality of carrier means secured to the lamp fitting, each carrier means having formed on it at least one linear series of parallel tooth members; and a plurality of support members each having a respective support surface for engaging a surface of the planar support, each support member including means for locating the support member on a respective carrier means such that the support member may slide in the direction of the linear series, each support member including at least one engagement surface for engagement with a chosen tooth member within the series such that in use of the mounting arrangement, the engagement surface is maintained in engagement with the tooth member by the weight of the fitting acting on the engagement surface.

Thus in a mounting arrangement in accordance with the invention, as the weight of the fitting maintains the engagement surfaces of the support members in engagement with the respective teeth, the effectiveness of the mounting is not totally dependent on the resilience of the support members. Furthermore the support members may be cheaply manufactured from, for example, a mouldable plastics material thus reducing both the cost and the weight of the mounting arrangement.

Preferably, the means for locating the support member prevents the support member from sliding in the direction of the linear series when the respective engagement surface is in engagement with the chosen tooth member.

Furthermore, when the respective engagement surface is not in engagement with the chosen tooth member, the means for locating the support member may allow the support member to slide in the direction of the linear series unhindered until the support surface engages the surface of the planar support.

Preferably the tooth members are each shaped such that when the weight of the fitting is not acting on the engagement surface the support member may readily be slid in only one direction.

Generally this one direction will be chosen to enable the lamp fitting to move upwards relative to the planar support, and not downwards, thus constituting a safety feature.

The means for locating the support member suitably comprises a pair of inturned lugs effective to partially enclose one of the carrier means.

Each support member preferably includes a body portion which when the respective engagement surface is in engagement with the chosen tooth member subtends an acute angle with the carrier means. The support surface will then suitably be angled with respect to the body portion such that in use of the mounting arrangement it is parallel to the planar support.

Each carrier means suitably includes two engagement surfaces. Such an arrangement gives further stability to the mounting arrangement.

According to a second aspect of the present invention, there is provided a lamp fitting incorporating a mounting arrangement according to the first aspect of the present invention.

One particular mounting arrangement in accordance with the invention will now be described, by way of example only, with reference to the accompanying drawings in which:

FIG. 4 is a times enlargement of the part of FIG. 3 enclosed in the circle labelled IV in FIG. 3;

FIG. 5 is a plan view of a first embodiment of the support arrangement shown in the fitting of FIG. 1, in accordance with one embodiment of the invention.

Figure 1:
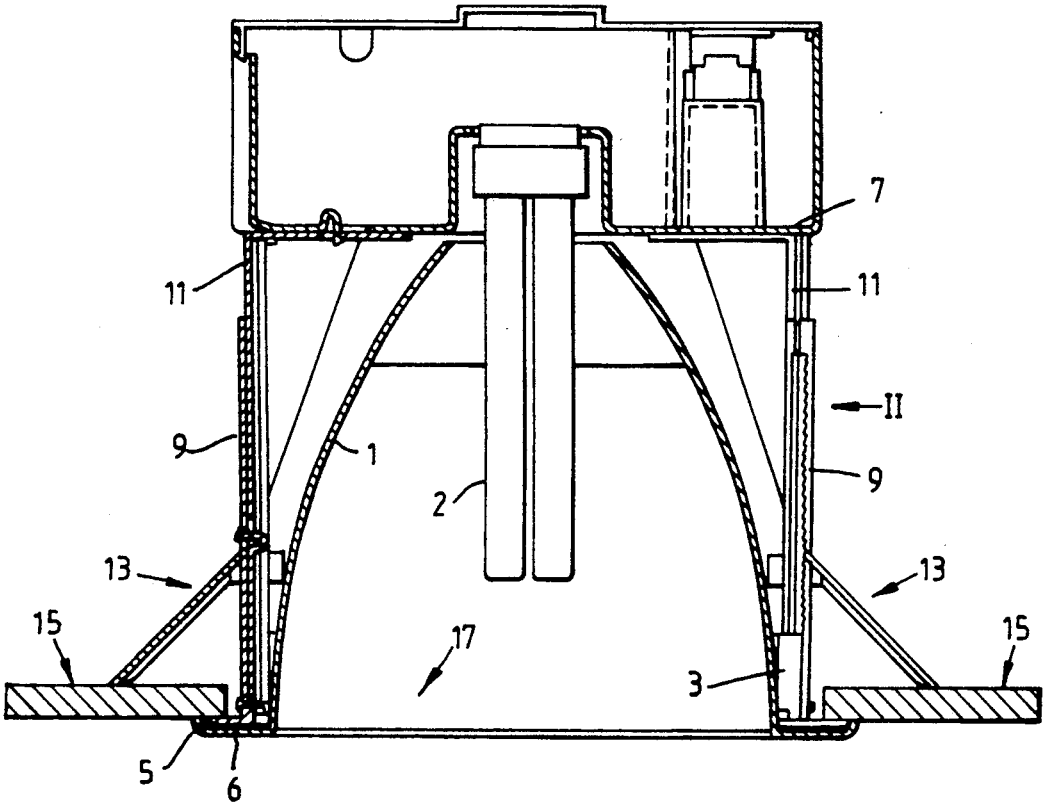
FIG. 1 is a schematic sectional view of the lamp fitting incorporating the mounting arrangement.

Referring firstly to FIG. 1, the fitting includes an approximately conical reflector 1 in which a lamp 2 is mounted. Surrounding the base of the reflector 1 is a ceiling ring 3, the ring 3 having at its lower edge an outwardly directed flange 5. A bezel 6 is mounted over the flange 5. Mounted at the top of the fitting is a gear tray 7, effective to carry electrical circuitry (not shown) for driving the lamp. The gear tray 7 is supported from two diametrically opposed legs 9 of the ceiling ring 3, via a respective one of two gear legs 11. In respect of each ceiling ring leg 9 there is provided a support member 13 which in use of the fitting is carried by the leg 9 as will be described in more detail hereafter. This support member 13 is effective to support the fitting on the upper surface of a ceiling tile forming part of a suspended ceiling 15, such that the lower part of the fitting projects through an aperture 17 formed in the ceiling 15. The ceiling ring 3 may be formed of any suitable material although a mouldable plastic such as polycarbonate is particularly appropriate. An appropriate material for the support members 13 is a resilient plastics material such as polycarbonate.

Figure 2:
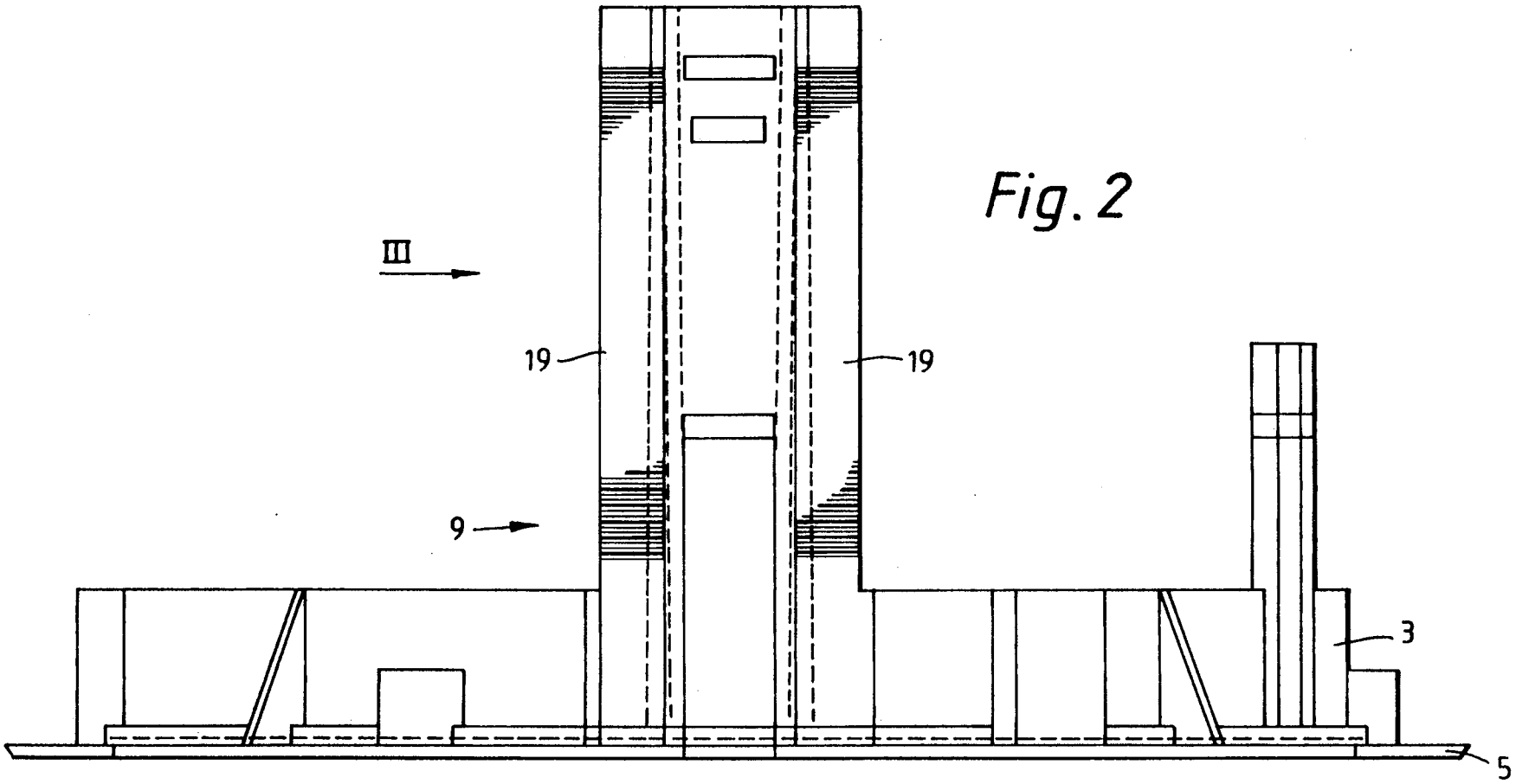
FIG. 2 is a side view of the ceiling ring incorporated in the fitting shown in FIG. 1 viewed along the direction of the arrow II in FIG. 1.
Figure 3:
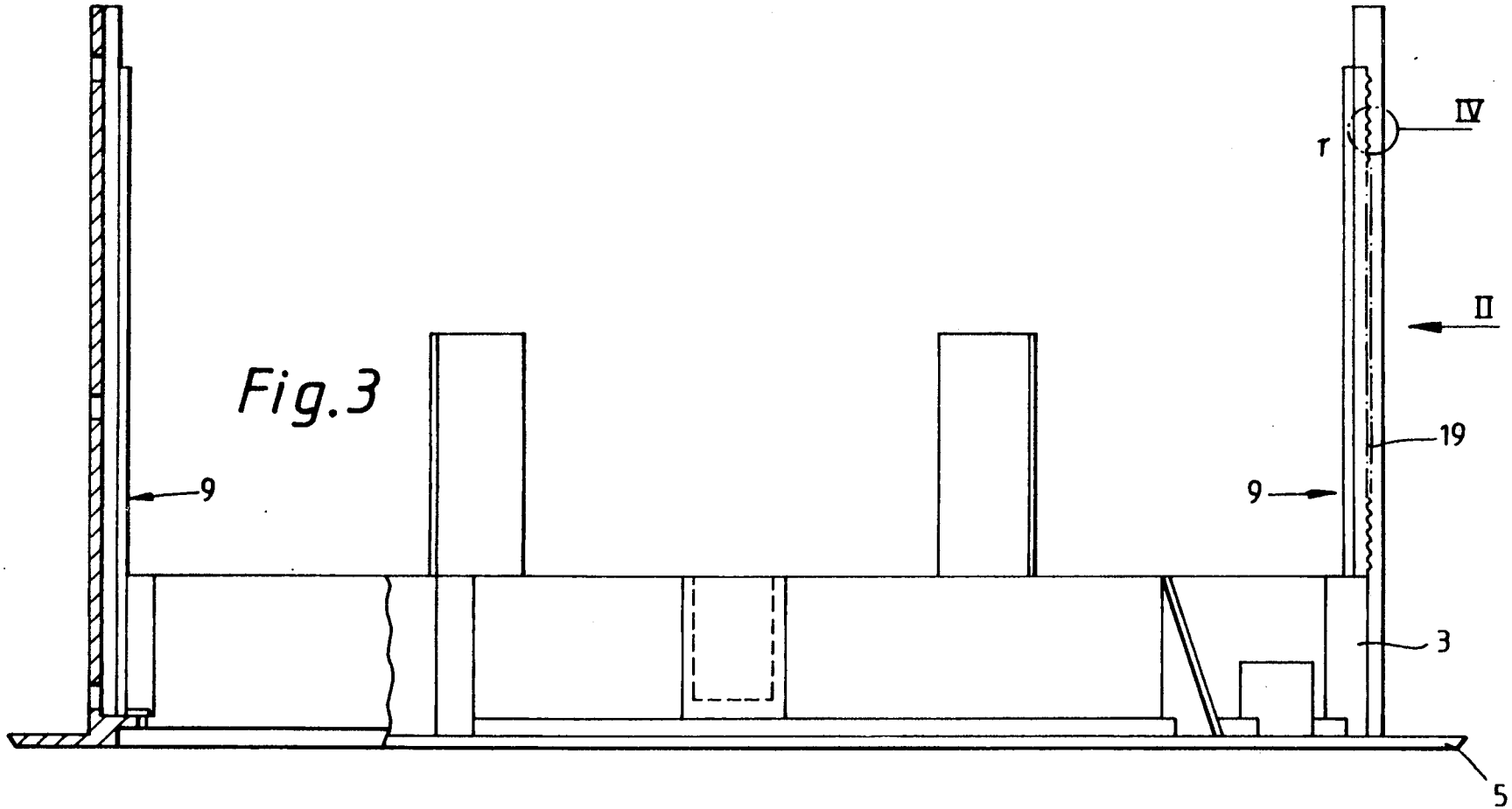
FIG. 3 is a partially sectioned side view of the ceiling ring incorporated in the fitting shown in FIG. 2, viewed along the direction of the arrow III in FIG. 2.

Referring now also to FIGS. 2, 3 and 4 which illustrate the legs 9 of the ceiling ring 3 in more detail, the edge portions of the legs 9 are formed as a series of ratchet teeth 19. As best seen in FIG. 4, which shows the ratchet teeth for the right hand side leg 9 as seen in FIG. 3 each ratchet tooth has a straight under-surface 21 and a curved over-surface 23.

Figure 6:
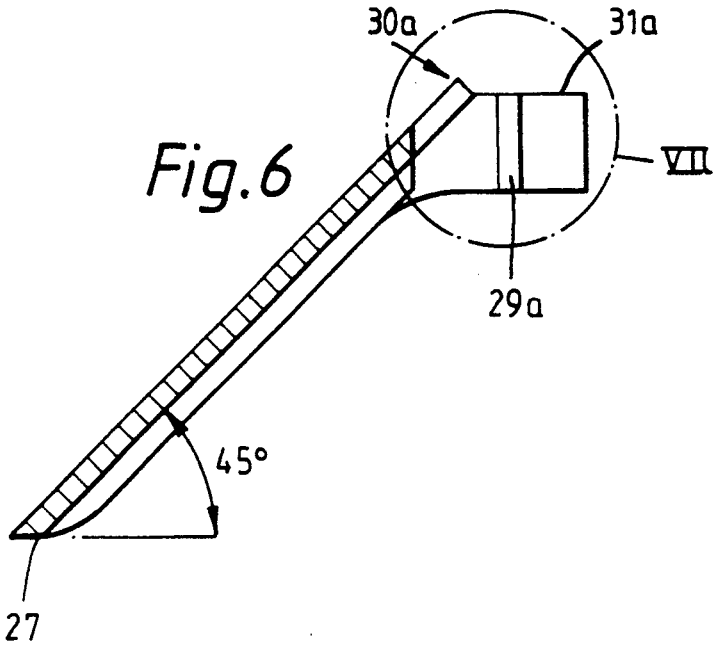
FIG. 6 is a side view of the support arrangement shown in FIG. 5, viewed along the arrow VI in FIG. 5.
Figure 7:
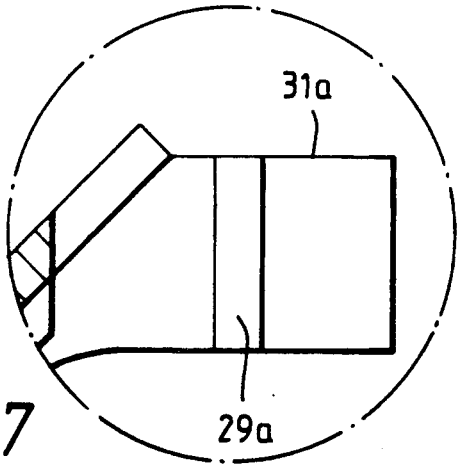
FIG. 7 is a times 2 enlargement of the part of FIG. 6 enclosed in the circle labelled VII.

Referring now to one particular embodiment of the invention as shown in FIGS. 5 and 6 each support member 13 comprises a planar body portion 25, the lower edge of which is curved to form a surface 27, at 45° to the body portion 25.

At the upper edge of the body portion 25 are formed two inwardly directed lugs 29*a*, 29*b*, these lugs extending in a plane at an angle of 45° to the plane of the body portion as best illustrated in FIG. 6. Respective ear portions 31*a*, 31*b* are formed on the lugs 29*a*, 29*b*.

The support member 13 is dimensioned such that each member 13 may be mounted on one of the legs 9 of the ceiling ring 3 with the lugs 29*a*, 29*b* lying on the internal surface of the legs 9 and generally parallel to the legs 9, and with the body portions 25 subtending an angle of 45° with each leg 9 as shown in FIG. 1.

The form of the support member 13 as best seen in FIG. 6, and the ratchet teeth 19 as best seen in FIG. 4 are such that the uppermost surfaces 30*a*, 30*b* of the support member 13 engage the lower surfaces 21 of the ratchet teeth 19. The curved upper surfaces 23 of the ratchet teeth allow the support members 13 to be moved down the respective legs 9, using the ear portions 31*a*, 31*b* as handles for the support members. The straight under-surfaces 21 of the ratchet teeth prevent the raising of the support members up the legs 9.

Thus, in use of the mounting arrangement the lower surfaces 27 of the two support members engage the horizontal upper surface of the suspended ceiling 15 so as to support the lamp fitting. The fitting may move in an upwards direction relative to the ceiling 15 through the aperture 17, if the position of the two support members 13 on the legs 9 is adjusted. The fitting is however prevented from moving downwards when the support members 13 are in place. The weight of the fitting on the upper surfaces 30*a*, 30*b* of the support member, together with the action of the lugs 29*a*, 29*b* is sufficient to maintain the surfaces 30*a*, 30*b* in engagement in the ratchet teeth thus effectively locking the lamp fitting in position after the ceiling tile is fitted in place in the ceiling 15.

Referring now to a second embodiment of the invention as shown in FIGS. 8 to 11, in which like parts are designated by like numerals in respect of the first embodiment, each support member 13 comprises a planar body portion 25, the lower edge of which is curved to form a surface 27 to the body portion 25.

Figure 8:
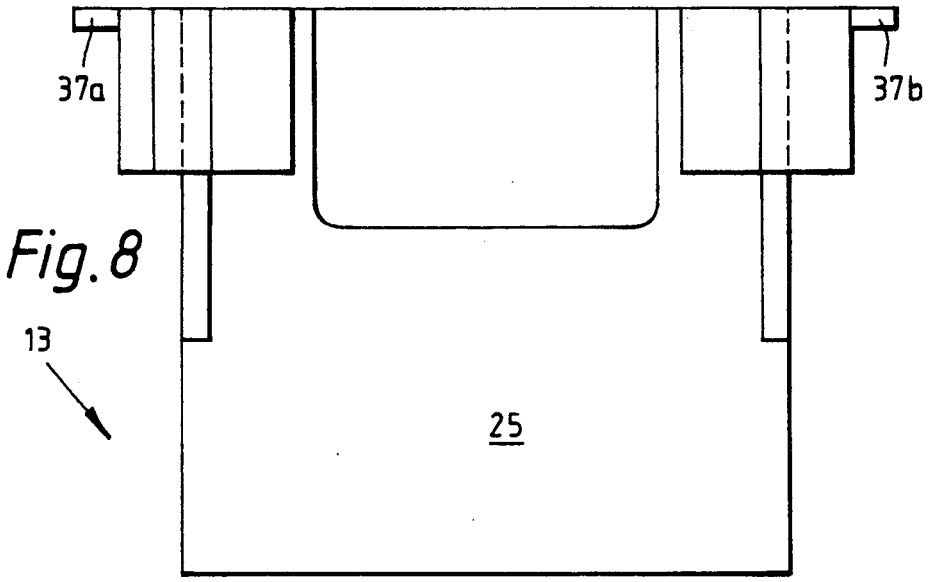
FIG. 8 is a plan view of the support arrangement, in accordance with a second embodiment of the invention.
Figure 9:
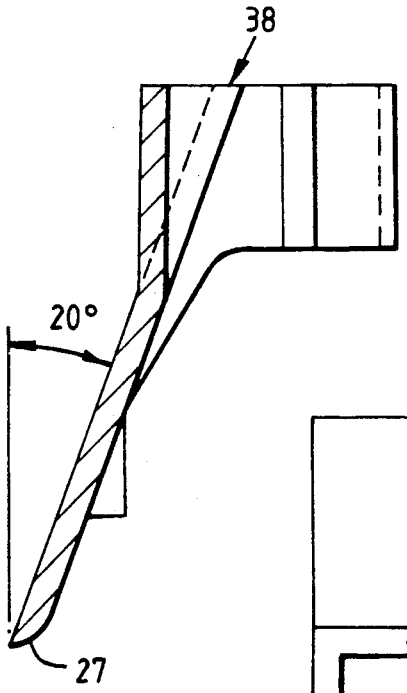
FIG. 9 is a sectioned side view of the support arrangement shown in FIG. 8.

At the upper edge of the body portion 25 are formed two inwardly directed lugs 35*a*, 35*b*, these lugs extending in a plane at an angle of 20° to the plane of the body portion as best illustrated in FIG. 9. Respective ear portions 36*a*, 36*b* are formed on lugs 35*a*, 35*b*. These ear portions may comprise a platform 37*a*, 37*b* as illustrated in FIG. 8 in order to ease installation of the support member into the lamp fitting.

Figure 10:
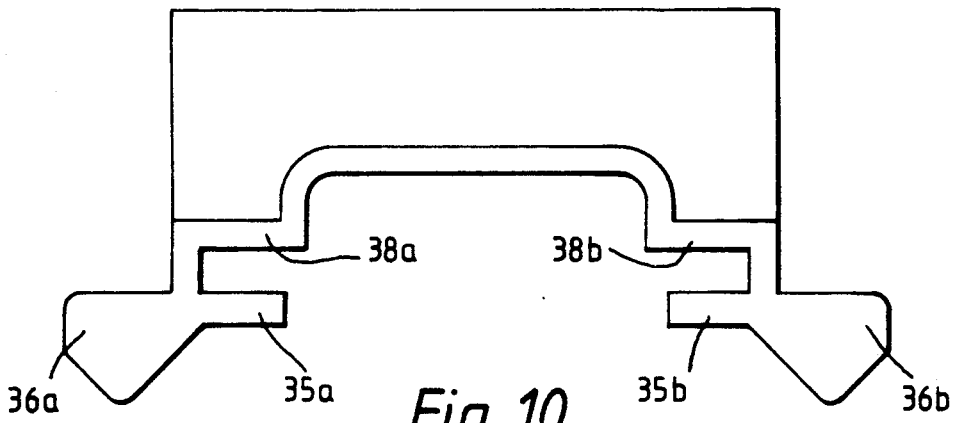
FIG. 10 is an end view of the support arrangement shown in FIG. 8.
Figure 11:
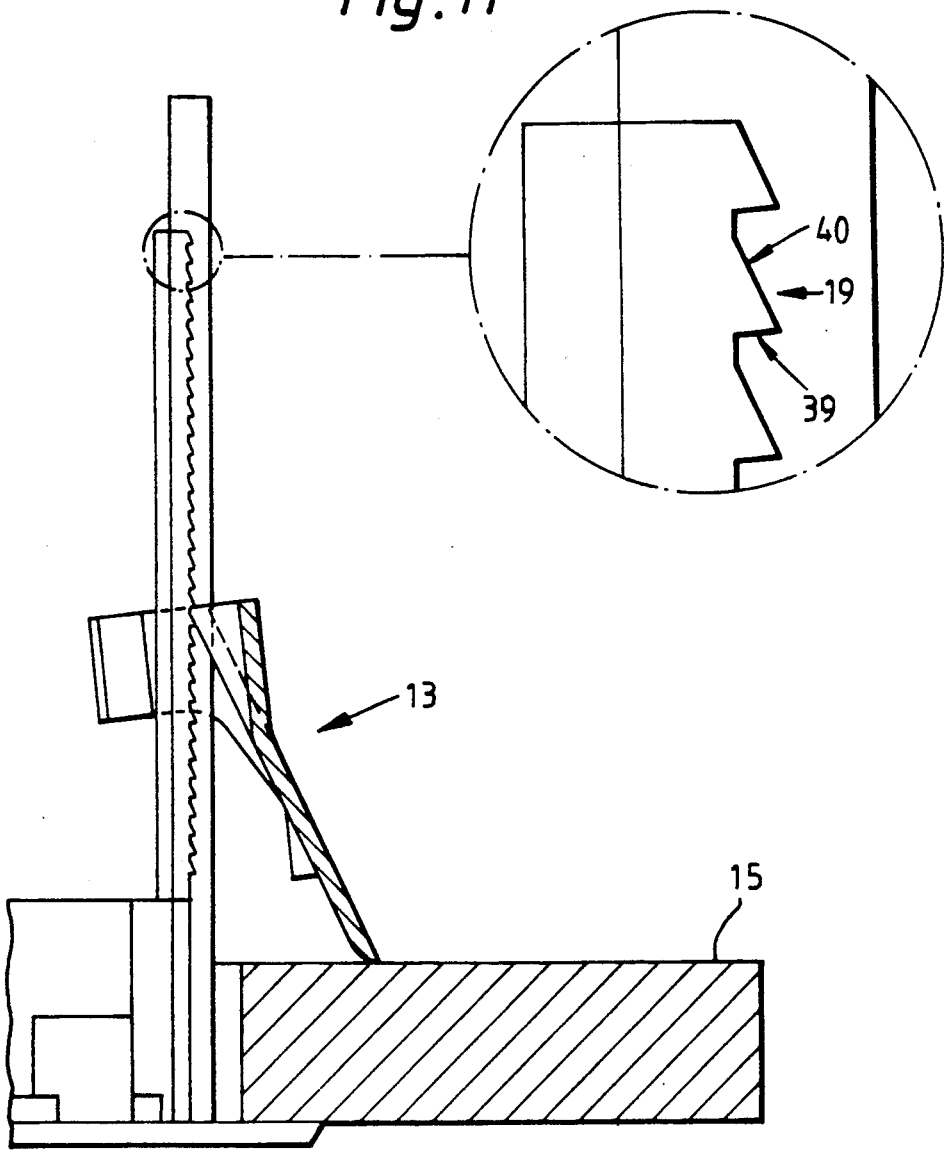
FIG. 11 is a partially sectioned side view of part of the ceiling, a leg and the support member, in accordance with the second embodiment of the invention.

The support member 13 is dimensioned such that each member 13 may be mounted on one of the legs 9 of the ceiling ring with the lugs 35*a*, 35*b* lying on the internal surface of the legs 9 and generally parallel to the legs 9, as shown in FIG. 11. The form of the support member 13 as best seen in FIGS. 9 and 10, and the ratchet teeth 19 as best seen in FIG. 11 are such that the uppermost surfaces 38*a*, 38*b* of the support member 13 engage the lower surfaces 39 of the ratchet teeth 19. The shaped upper surfaces 40 of the ratchet teeth allow the support members 13 to be moved down the respective legs 9, utilizing the positioning of the lugs 35*a* and 35*b*. The straight under-surfaces 39 of the ratchet teeth prevent the raising of the support members up the legs 9.

Thus, in use of the mounting arrangement, the support member 13 is first positioned such that the planar body portion 25 subtends an angle of approximately 20° with each leg 9 such that the support members 13 is able to allow the ratchet teeth 19 to pass by the lugs until the lower surfaces 27 of the support member engages the horizontal upper surface of the suspended ceiling 15. It is the position of the lugs relative to the legs that governs the engagement between the surfaces 38*a*, 38*b* and the ratchet teeth. If the lugs are parallel to the linear series of ratchet teeth formed at the edge of the legs 9, the surfaces 38*a*, 38*b* do not engage in the ratchet teeth and thus the lamp fitting is not locked into position in the ceiling.

If however the lugs are positioned such they are not parallel to the series of ratchet teeth formed on the legs 9, the surfaces 38*a*, 38*b* engage in the ratchet teeth and the lamp fitting is locked into position in the ceiling.

Hence, in use, this type of support member 13 would drop down onto the ceiling surface whilst the lugs were parallel to the legs and then intervention would be required in order to secure the fitting into the ceiling by utilizing the ear portions to cause surfaces 38*a*, 38*b* to engage in the ratchet teeth and lock.

Generally these fittings will be inserted in the ceiling tile without the lamp 2, reflector 1 and bezel ring 6 so as to reduce the weight acting on the tile during its insertion in the ceiling. These components are then added after the tile has been placed in position in the ceiling 15.

I claim:

1. A mounting arrangement for mounting a lamp fitting on a planar support, the mounting arrangement comprising:

a plurality of carrier means secured to the lamp fitting, each carrier means having formed on it at least one linear series of tooth members;

and a plurality of support members, each support member comprising a body portion having a respective support part at one end shaped for engaging a surface of the planar support and, at the other end, location means for locating the support member on a respective carrier means such that the support member may slide in the direction of the linear series, the location means including at least one engagement surface for engagement with an appropriate tooth member of the series such that, in use of the mounting arrangement, the support part engages the surface of the planar support and the shortest distance between the support part and the at least one engagement surface defines a notional line, such that the notional line subtends an angle of at least 45 degrees to the surface of the planar support, whereby the engagement surface is maintained in engagement with the tooth member and the support part is engaged on the surface of the planar support essentially by the weight of the fitting acting on the engagement surface.

2. A mounting arrangement according to claim 1 wherein the means for locating the support member prevents the support member from sliding in the direction of the linear series when the respective engagement surface is in engagement with the chosen tooth member.

3. A mounting arrangement according to claim 2 wherein when the respective engagement surface is not in engagement with the chosen tooth member, the means for locating the support member allows the support member to slide in the direction of the linear series unhindered until the support surface engages the surface of the planar support.

4. A mounting arrangement according to claim 1 wherein the tooth members are each shaped such that when the weight of the fitting is not acting on the engagement surface the support member may readily be slid in only one direction.

5. A mounting arrangement according to claim 1 wherein the means for locating the support member suitably comprises a pair of inturned lugs effective to partially enclose one of the carrier means.

6. A mounting arrangement according to claim 1 wherein each carrier means includes two engagement surfaces.

7. A mounting arrangement as illustrated by claim 1 wherein the support members are formed from mouldable plastics material.

8. A lamp fitting incorporating a mounting arrangement according to claim 1.

9. A mounting arrangement according to claim 1 wherein the notional line subtends an angle of not more than 70 degrees.

10. A mounting arrangement according to claim 1 wherein there is a single contact between said mounting arrangement and the surface of the planar support.

* * * * *